US007288721B2

(12) United States Patent
Varkey et al.

(10) Patent No.: US 7,288,721 B2
(45) Date of Patent: Oct. 30, 2007

(54) ELECTRICAL CABLES

(75) Inventors: Joseph P. Varkey, Missouri City, TX (US); Byong Jun Kim, Sugar Land, TX (US); Willem A. Wijnberg, Houston, TX (US); Faisal Arif, Al-Khobar (SA); Anil Singh, Stafford, TX (US); Jeffrey Arnaud, Missouri City, TX (US); John Cuong Nguyen, Tomball, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/024,305

(22) Filed: Dec. 28, 2004

(65) Prior Publication Data

US 2006/0137895 A1 Jun. 29, 2006

(51) Int. Cl.
*H01B 7/18* (2006.01)

(52) U.S. Cl. ..... 174/102 R; 174/107; 174/108

(58) Field of Classification Search ..... 174/102 R, 174/103, 106, 105 R, 108, 110 R, 113 R, 174/120 R, 121 R; 385/100–101, 106–107, 385/109, 111

See application file for complete search history.

(56) References Cited

U.S. PATENT DOCUMENTS 2,953,627 A * 9/1960 Malneritch et al. ..... 174/102 R
3,602,632 A * 8/1971 Ollis ..... 174/36
3,773,109 A * 11/1973 Eberline ..... 340/855.1
3,784,732 A * 1/1974 Whitfill, Jr. ..... 174/108
4,440,974 A * 4/1984 Naudet ..... 174/108
4,880,679 A * 11/1989 Bonazza ..... 428/57
5,086,196 A 2/1992 Brookbank et al. ..... 174/106 R
5,300,362 A * 4/1994 Auerbach et al. ..... 428/375
5,426,264 A * 6/1995 Livingston et al. ..... 174/102 R
5,917,154 A * 6/1999 Mortier ..... 174/117 FF
6,060,662 A * 5/2000 Rafie et al. ..... 174/106 R
6,195,487 B1 2/2001 Anderson et al. ..... 385/101
6,236,789 B1 5/2001 Fitz ..... 385/101
6,403,889 B1 6/2002 Mehan et al. ..... 174/120
6,600,108 B1 * 7/2003 Mydur et al. ..... 174/120 R

OTHER PUBLICATIONS

Engineering Design Guide, 3rd Edition, C & M Corporation, Jan. 1992. pp. 2 & 10-14.*

S.M. Lebedev, O.S. Gefle, Yu.P.Pokholkov and V.I. Chichikin, "The Breakdown Strength of Two-Layer Dielectrics", Tomsk Polytechnic University, Tomsk, Russia #4.304.P2, High Voltage Engineering Symposium, Aug. 22-27, 1999.

M.M.A. Salama, R.Hackam, Fellow and A.Y. Chikhani, Sr., "Instructional Design of Multi-Layer Insulation of Power Cables", Transaction on Power Systems, vol. 7, No. 1, Feb. 1992, pp. 377-382.

* cited by examiner

*Primary Examiner*—William H. Mayo, III
(74) *Attorney, Agent, or Firm*—David Cate; Jaime Castano; Dale Gaudier

(57) ABSTRACT

Disclosed are durable corrosion resistant wellbore electrical cables including a coated electrical conductor, a polymeric protective layer for trapping coating flakes, a first insulating jacket disposed adjacent to the polymeric protective layer and having a first relative permittivity. A second insulating jacket is disposed adjacent to the first insulating jacket and has a second relative permittivity that is less than the first relative permittivity. Another aspect of the invention is a method for manufacturing a cable that includes providing a coated electrical conductor, extruding a polymeric protective layer over the coated electrical conductor, extruding a first insulating jacket over the protective polymeric layer, and extruding a second insulating jacket thereon. Cables of the invention may further include armor wire layers or even current return conductors.

31 Claims, 4 Drawing Sheets

ELECTRICAL CABLES

BACKGROUND OF THE INVENTION

1. Field of the Invention

This invention relates to a redistributed electric field cable and a method of manufacturing same. In one aspect, the invention relates to a corrosion resistant redistributed electric field cable used with devices to analyze geologic formations adjacent a well before completion and a method of manufacturing same.

2. Description of the Related Art

Generally, geologic formations within the earth that contain oil and/or petroleum gas have properties that may be linked with the ability of the formations to contain such products. For example, formations that contain oil or petroleum gas have higher electrical resistivity than those that contain water. Formations generally comprising sandstone or limestone may contain oil or petroleum gas. Formations generally comprising shale, which may also encapsulate oil-bearing formations, may have porosities much greater than that of sandstone or limestone, but, because the grain size of shale is very small, it may be very difficult to remove the oil or gas trapped therein.

Accordingly, it may be desirable to measure various characteristics of the geologic formations adjacent to a well before completion to help in determining the location of an oil- and/or petroleum gas-bearing formation as well as the amount of oil and/or petroleum gas trapped within the formation. Logging tools, which are generally long, pipe-shaped devices, may be lowered into the well to measure such characteristics at different depths along the well. These logging tools may include gamma-ray emitters/receivers, caliper devices, resistivity-measuring devices, neutron emitters/receivers, and the like, which are used to sense characteristics of the formations adjacent the well. A wireline cable connects the logging tool with one or more electrical power sources and data analysis equipment at the earth's surface, as well as providing structural support to the logging tools as they are lowered and raised through the well. Generally, the wireline cable is spooled out of a truck, over a sheave, and down into the well. The wireline cables typically have an outside diameter as small as possible to maximize the cable length on a drum. Other desirable characteristics include high strength to weight rations, high power delivery, high corrosion resistance and good data transmission.

Wireline cables are typically formed from a combination of metallic conductors, insulative material, filler materials, jackets, and metallic armor wires. In the manufacture of cables, it is common to utilize extrusion processing to form an insulating jacket adjacent the conductor, or conductors, of the cable. It is desirable for some applications to form a dielectric cable by using more than one insulative jacket adjacent the conductor(s) to achieve certain dielectric properties. U.S. Pat. No. 6,600,108 (Mydur et al.), incorporated by reference herein, describes cables with two different insulative jackets formed around conductor(s) to provide a cable capable of transmitting larger amounts of power with minimal electrical insulation, by reducing the peak electric field strength induced in the electrical power voltage range. This allows the cable diameter to remain as small as possible. This design may also avoid using the metallic armor as an electrical return conductor, as such configurations may present a hazard to personnel and equipment that inadvertently come into contact with the armor wires during operation of the logging tools. Further, in some applications, dielectric wireline cables are exposed to significant levels of corrosive chemicals, such as hydrogen sulfide.

The presence of corrosive chemicals, such as hydrogen sulfide, in wells or well fluids can cause significant damage to armor wires and metallic conductors. For example, hydrogen sulfide, in the form of a gas or a gas dissolved in liquids, attacks metals by combining with them to form metallic sulfides and atomic hydrogen. The destructive process is principally hydrogen embrittlement, accompanied by chemical attack. Chemical attack may be commonly referred to as sulfide stress cracking. Hydrogen sulfide attacks metals with a wide variation in intensity. High-strength steels used in armor wires, which have high carbon content and are highly cold-worked, are particularly susceptible to damage by hydrogen sulfide. Therefore, metals and special alloys that are very corrosion resistant must be used as armor wire material. To protect against damage by hydrogen sulfide or other corrosive chemicals, specially modified metallic electrical conductors are typically used. The individual metallic conductors are typically coated with metal, typically nickel, before being insulated. Coated conductors have higher resistance that traditional uncoated conductors thereby limiting the ability to transmit power for a given cable diameter.

Coated metallic conductors are prone to having the coating flake off during the manufacture, handling, and use. Because the conductor and coating metals may have differing coefficients of thermal expansion, the coating can flake off when the wire is exposed to the heat of the extruder. The coating may also flake off as the wire is bent over tensioning pulleys. The coating may also be rubbed off through contact friction at the extruder tip. The coating flakes tend to mix with the insulation layers or jackets thereby causing localized electric field enhancement which may lead to partial discharge activity or even a reduction in dielectric strength. This may result in a loss of ability to adequately transmit power.

Thus, a need exists for cables that are capable of transmitting larger amounts of power while maintaining a small cable diameter and remaining corrosion resistant. A cable that can overcome the problems detailed above while transmitting larger amounts of power while maintaining data signal transmission integrity would be highly desirable, and the need is met at least in part by the following invention.

BRIEF SUMMARY OF THE INVENTION

In one aspect of the invention, an electrical cable is provided. The cable includes an electrical conductor made of a central metallic conductor and a plurality of coated metallic conductors helically positioned around the central metallic conductor, a polymeric protective layer disposed adjacent to the electrical conductor, a first insulating jacket disposed adjacent the polymeric protective layer and having a first relative permittivity. A second insulating jacket disposed adjacent the first insulating jacket and having a second relative permittivity that is less than the first relative permittivity.

In another aspect of the invention, an electrical cable is provided which includes a plurality of insulated electrical conductors, wherein each insulated electrical conductor includes a central coated metallic conductor and a plurality of coated metallic conductors helically positioned around the central metallic conductor, a polymeric protective layer disposed adjacent the electrical conductor, a first insulating jacket disposed adjacent the polymeric layer wherein the first insulating jacket has a first relative permittivity, and, a second insulating jacket disposed adjacent the first insulating jacket and having a second relative permittivity that is less than the first relative permittivity. The electrical cable further includes an electrically non-conductive jacket surrounding the insulated electrical conductors, an interstitial filler disposed between the jacket and insulated electrical conductors, and a plurality of insulated current return conductors disposed between the jacket and said insulated electrical conductors. Two corrosion resistant armor wire layers surround the jacket.

Another embodiment of the invention provides an electrical cable which includes a plurality of insulated electrical conductors, wherein each insulated electrical conductor includes a central coated metallic conductor and a plurality of coated metallic conductors helically positioned around the central metallic conductor, a polymeric protective layer disposed adjacent the electrical conductor, a first insulating jacket disposed adjacent the polymeric layer wherein the first insulating jacket has a first relative permittivity, and, a second insulating jacket disposed adjacent the first insulating jacket and having a second relative permittivity that is less than the first relative permittivity. The electrical cable further includes an electrically non-conductive jacket surrounding the insulated electrical conductors, and an interstitial filler disposed between the jacket and insulated electrical conductors. Armor wire layers surrounding the jacket also include at least one current return conductor.

In yet another aspect of the invention, a method is provided for manufacturing a cable. The method includes providing a coated electrical conductor, extruding a polymeric protective layer over the coated electrical conductor, extruding a first insulating jacket having a first relative permittivity over the polymeric protective layer, and extruding a second insulating jacket having a second relative permittivity over the electrical conductor, wherein the second relative permittivity is less than the first relative permittivity.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which.

DETAILED DESCRIPTION OF THE INVENTION

Figure 1:
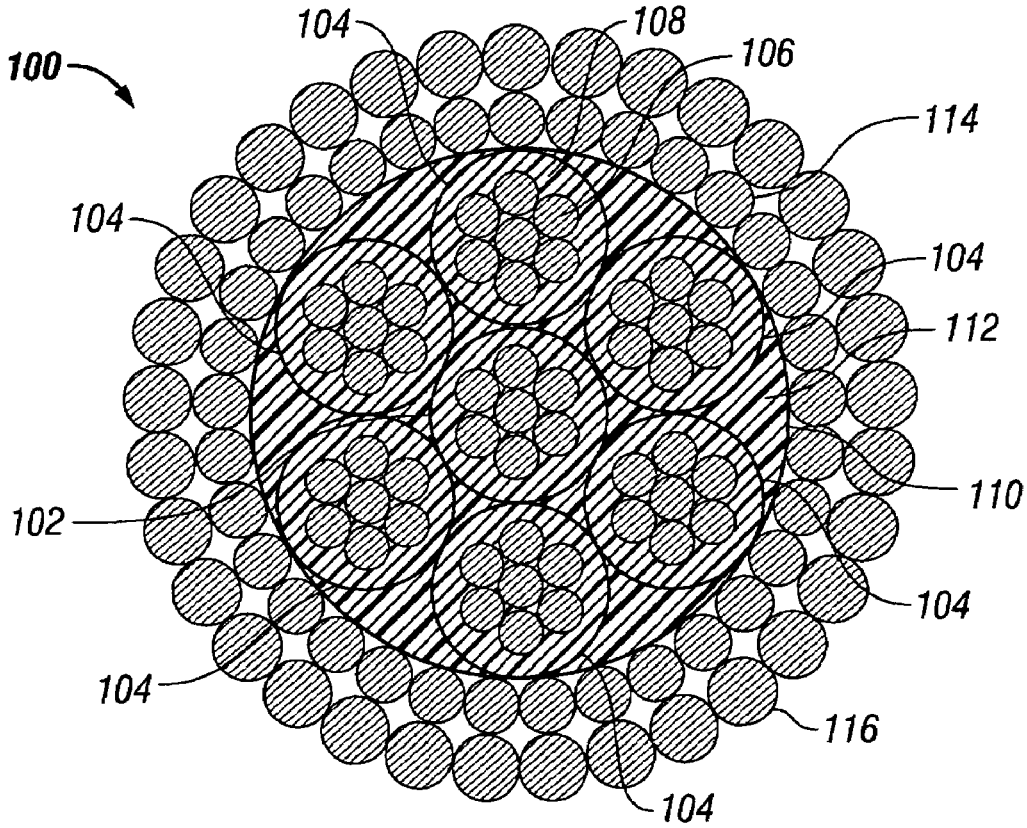
FIG. 1 (Prior Art)
FIG. 1 is a stylized cross-sectional view of a typical prior art cable design.

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

An electrical voltage applied to an electrical conductor produces an electric field around the conductor. The strength of the electric field varies directly according to the voltage applied to the conductor. When the voltage exceeds a critical value (i.e., the inception voltage), a partial discharge of the conductor may occur. Partial discharge is a localized ionization of air or other gases near the conductor, which breaks down the air. In electrical cables, the air may be found in voids within the material insulating the conductor and also between the insulation and surface of the conductor. When the electric field across a void becomes strong enough a partial discharge may occur. Such partial discharges are generally undesirable, as they progressively compromise the ability of the insulating material to electrically insulate the conductor. If the electric field generated by electricity flowing through the conductor can be at least partially suppressed by redistributing the electric field hence lowering the maximum intensity of the electric field, the likelihood of partial discharge may be reduced. U.S. Pat. No. 6,600,108 describes cables designed to suppress the electric field by forming multiple insulation jackets over the electrical conductors.

Coated metallic electrical conductors are commonly used when the presence of corrosive chemicals, such as hydrogen sulfide, in wells or well fluids have the potential to cause significant damage to metallic conductors. The metallic conductors are typically coated with metal, such as nickel, before being insulated. During the manufacture, handling, and use of electrical cables containing coated metallic conductors, the coating is prone to flaking off. These coating flakes tend to mix with the insulation layers, and because of their metallic nature, may cause localized electric field enhancement which lead to partial discharge problems (that is, a reduction in inception and extinction voltages), The coating flakes may even result in breaking down the dielectric strength, thus eliminating the advantages provided by stacked dielectric cables.

It has been discovered that incorporating a polymeric protective layer adjacent to electrical conductors, that include corrosion resistant coated metallic conductors, provides a cable with excellent dielectric properties, corrosion resistance, and durability. While this invention and its claims are not bound by any particular mechanism of operation or theory, it is believed that including a polymeric protective layer adjacent to electrical conductors traps or contains any corrosion resistant coating flake off, which in turn improves the problems related to dielectric strength reduction or reduction of partial discharge inception and extinction voltages.

In the electrical cable embodiments of the invention, a central metallic conductor is helically wrapped with a plurality of coated metallic conductors to form an electrical conductor. The central metallic conductor may be either uncoated, or coated in a manner similar with the other coated metallic conductors. The electrical conductor is then coated with a polymeric protective layer, and two further insulative jackets to form a stacked dielectric insulated conductor resistant to corrosive downhole conditions. A stacked dielectric insulated conductor may either be used individually to form a cable, or combined with other such insulated conductors to form a larger cable. One or more armor wire layers may then be helically served upon the cable for protection and strength.

FIG. 1 depicts a cross-section of a typical cable design commonly used for downhole applications. The cable 100 includes a central insulated conductor 102 having multiple electrical conductors and an outer insulating material. The cable 100 further includes a plurality of outer insulated conductors 104, each having several metallic conductors 106 (only one indicated), and an insulating material 108 (only one indicated) surrounding the outer electrical conductors 106. Commonly, the electrical conductor 106 is a copper conductor. The central insulated conductor 102 of typical prior art cables, is essentially the same design as the outer insulated conductors 104. A tape and/or tape jacket 110 made of a material that may be either electrically conductive or electrically non-conductive and that is capable of withstanding high temperatures encircles the outer insulated conductors 104. The volume within the tape and/or tape jacket 110 not taken by the central insulated conductor 102 and the outer insulated conductors 104 is filled by a filler 112, which may be made of either an electrically conductive or an electrically non-conductive material. A first armor layer 114 and a second armor layer 116, generally made of a high tensile strength material such as galvanized improved plow steel, alloy steel, or the like, surround and protect the tape and/or tape jacket 110, the filler 112, the outer insulated conductors 104, and the central insulated conductor 102.

Figure 2:
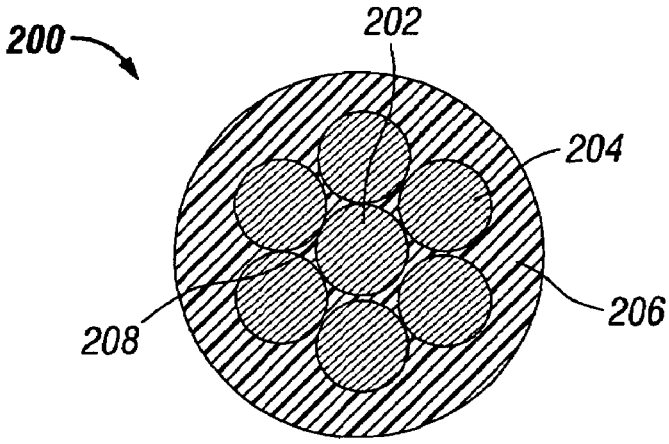
FIG. 2 (Prior Art)
FIG. 2 is a cross-sectional view of a typical prior art insulated conductor, typically used in prior art cable design of FIG. 1.

A typical prior art insulated conductor, such as the insulated conductors 102 or 104 of prior art FIG. 1, is illustrated in FIG. 2. In FIG. 2, the insulated conductor 200 comprises electrical conductors 202 and 204 (only one indicated). Electrical conductors 202 and 204 may be stranded or solid conductors. Electrical conductors 202 and 204 are typically uncoated copper or aluminum conductors. The insulated conductor 200 is typically a seven-strand copper wire conductor having a central conductor and six outer conductor laid around the central conductor. The outer electrical conductors 204 are typically surrounded with a non-conductive insulation material 206. Such non-conductive insulation materials typically are PEEK, PEKK, ETFE, or other fluoropolymers and polyolefins. The interstices 208 formed between the outer electrical conductors 204 and central electrical conductor 202, are commonly filled with a non-conductive insulation material as well.

Figure 3:
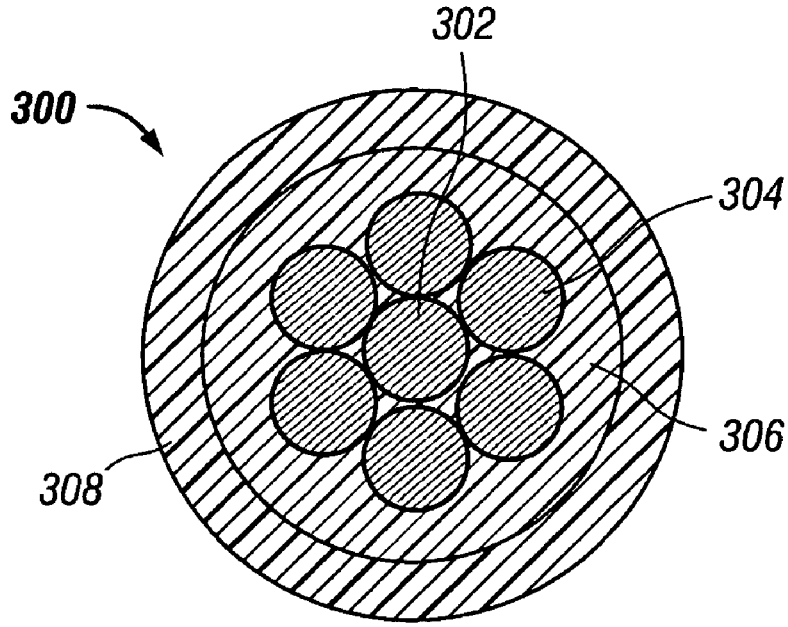
FIG. 3 (Prior Art)
FIG. 3 is a stylized cross-sectional view of a stacked dielectric insulated conductor.

Referring now to FIG. 3, which illustrates a stacked dielectric insulated conductor, such as those disclosed in U.S. Pat. No. 6,600,108 (Mydur, et al.), hereinafter incorporated by reference, stacked dielectric insulated conductors are used in cables designed to suppress the electric field by forming multiple insulation jackets over the electrical conductors. Stacked dielectric insulated conductor 300 includes a central electrical conductor 302 surrounded by outer electrical conductors 304 (only one indicated). A first insulating jacket 306 is disposed around the electrical conductors 302 and 304, and having a first relative permittivity. The first insulating jacket 306 may be made of a PEEK or PPS polymer. A second insulating jacket 308 is disposed around the first insulating jacket 306. The second insulating jacket is typically be made of polytetrafluoroethylene-perfluoromethylvinylether polymer, perfluoro-alkoxyalkane polymer, polytetrafluoroethylene polymer, ethylene-tetrafluoroethylene polymer, ethylene-polypropylene copolymer, or fluoropolymer. The second insulating jacket 308 has a second relative permittivity that is less than the relative permittivity of the first insulating jacket 306.

As described above, as an added protection against damage by downhole corrosive conditions, electrical conductors may be specially modified with a coating. In the preparation of dielectric insulated conductors, compression extrusion of insulative layers is desirable for better inception and extinction voltages and helps block pressurized downhole gases from traveling up the conductor between the wire and the insulation. However, during such processing, corrosion resistant conductor coatings may be prone to flaking off. In the manufacture of a dielectric cable, such as that described in FIG. 3, in the compression extrusion of nickel-coated copper, for example, the nickel coating tends to flake off and mix with the first insulating layer or jacket, thereby nullifying the beneficial effects of stacked dielectrics and compression extrusions, as well as possibly causing a reduction in dielectric strength.

Figure 4:
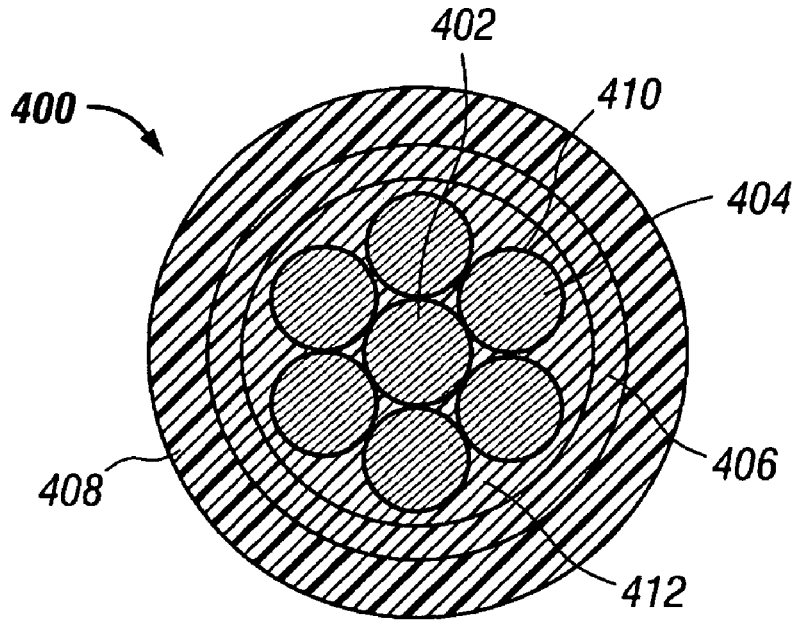
FIG. 4 illustrates, in cross section, an embodiment of a cable according to the invention, a stacked dielectric conductor with a protective polymeric layer.

FIG. 4 illustrates, in cross-section, an embodiment according to the invention, which is a stacked dielectric insulated conductor with a protective polymeric layer. Coated outer metallic conductors 404 (only one indicated) surround central metallic conductor 402, which may be coated or uncoated. The outer metallic conductors 404 may be parallel or helically positioned relative to central metallic conductor 402. The metallic conductors 402 and 404 may be made of any conductive metallic material. Copper and aluminum are preferred metallic conductors. As an added protection against damage by corrosive materials, electrical conductors 402 and 404 may be coated with a protective coating 410. The coating 410 is typically a metal, preferably a nickel coating. The capacitance of the insulated conductor may be within the range of from about 98 to about 230 picofarads per meter.

Referring again to FIG. 4, a protective polymeric layer 412 is disposed around the outer metallic conductors 404. The polymeric protective layer 412 may also fill the interstitial spaces formed between the coated outer metallic conductors 404 and a central metallic conductor 402. The polymeric protective layer 412 may be from about 1 to about 153 micrometers, preferably from about 10 micrometers to about 153 micrometers, thick as measured between the outermost surface of metallic conductor 404 and the inner surface of insulating jacket 406. The polymeric protective layer 412 may be comprised of any suitable material capable of trapping flake-off of the conductor coating and preventing flake-off contamination into the outer insulating layers. Examples of suitable polymeric protective layer materials include, but are not necessarily limited to, polyaryletherether ketone (PEEK), polyphenylene sulfide (PPS), polymers of ethylene-tetrafluoroethylene (Tefzel®), polymers of poly(1, 4-phenylene) (Parmax®), or any other polymer with a dielectric constant greater than 2.3. The polymeric protective layer may be either electrically conductive or electrically nonconductive. A first insulating jacket 406 is disposed over the protective polymeric layer 412, and may be composed of polyaryletherether ketone (PEEK), polyphenylene sulfide (PPS), Tefzel®, Parmax®, or other polymer with a dielectric constant greater than 2.3 and also greater than that of second insulating jacket 408, disposed over the first insulating jacket 406. The second insulating jacket 408 has a lower dielectric constant than the first insulating jacket 406 to create a stacked dielectric design. The second insulating layer may comprise a polytetrafluoroethylene-perfluoromethylvinylether polymer, perfluoro-alkoxyalkane polymer, polytetrafluoroethylene polymer, ethylene-tetrafluoroethylene polymer, ethylene-polypropylene copolymer, fluoropolymer, or any mixture thereof.

Figure 5:
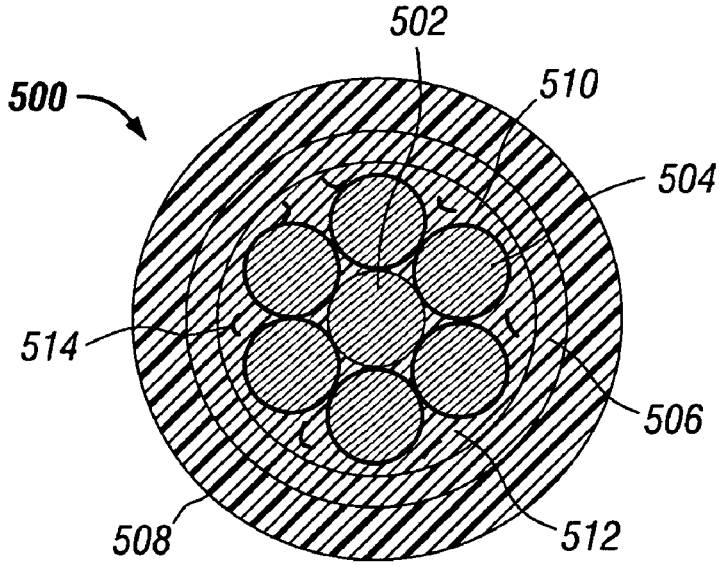
FIG. 5 illustrates, in cross section, an embodiment of a cable according to the invention, a stacked dielectric conductor with a protective polymeric layer.

Referring now to FIG. 5, which illustrates another embodiment of the invention, a stacked dielectric conductor with a nickel-trapping protective layer. Cable 500 includes a central coated metallic conductor 502 and outer coated metallic conductors 504 (only one indicated) disposed about the central metallic conductor 502. The metallic conductors 502 and 504 have a corrosion resistant nickel coating 510. A polyphenylene sulfide protective polymer layer 512 of thickness from about 10 micrometers to about 153 micrometers is compression extruded over the metallic conductors 502 and 504 to trap any nickel coating 510 flakes 514 that may occur during the extrusion process. A first insulating jacket of polyaryletherether ketone 506 is then extruded over the protective layer 512, and has a dielectric constant greater than 2.3. A second perfluoro-alkoxyalkane polymer insulating jacket 508 is extruded over the first insulating jacket 506 and has a dielectric constant less than or equal to 2.3.

The stacked dielectric cable 500, described in FIG. 5, and a similar cable, only without protective layer 512, were manufactured using tandem compression extrusion. Four individual seven meter lengths of each cable design were then tested for dielectric strength to demonstrate the effects of a polyphenylene sulfide protective polymer layer 512 on dielectric breakdown strength. As illustrated in Table 1, the four cable lengths with a polyphenylene sulfide protective polymer layer 512, Example 2, showed significantly increased voltage and more consistent voltage breakdown levels. Example 1 showed the negative effect of nickel flaking on dielectric breakdown strength, without a polymeric protective layer. Further, as Table 1 indicates, in compression extrusion on nickel-coated copper without a protective layer, Example 1, the coating may flake off thereby nullifying the beneficial effects of stacked dielectrics and compression extrusion, and can cause widely varying, unpredictable voltage breakdown levels.

TABLE 1

Effect of a polyphenylene sulfide protective polymer layer on dielectric breakdown strength

| | Example 1 - Stacked Dielectric Cable | Example 2 - Stacked Dielectric Cable with a PPS Polymeric Protective Layer |
|---|---|---|
| 1 | 18.6 KV | 37.1 KV |
| 2 | 33.5 KV | 35.1 KV |
| 3 | 23.6 KV | 30.5 KV |
| 4 | 27.0 KV | 37.7 KV |

Referring back to FIG. 4, the first insulating jacket 406 is prepared from a high polar dielectric material having a relative permittivity within a range of about 2.5 to about 10.0, such as polyaryletherether ketone polymer, polyphenylene sulfide polymer, polyether ketone polymer, maleic anhydride modified polymers, and Parmax® SRP polymers (self-reinforcing polymers manufactured by Mississippi Polymer Technologies, Inc based on a substituted poly (1,4-phenylene) structure where each phenylene ring has a substituent R group derived from a wide variety of organic groups), or the like, and any mixtures thereof. A particulary useful polyphenylene sulfide polymer (PPS) dielectric material is Fortron® PPS SKX-382 available from Ticona, Inc. Further, the second insulating jacket 408 is made of a dielectric material having a relative permittivity generally within a range of about 1.8 to about 5.0, such as polytetrafluoroethylene-perfluoromethylvinylether polymer (MFA), perfluoro-alkoxyalkane polymer (PFA), polytetrafluoroethylene polymer (PTFE), ethylene-tetrafluoroethylene polymer (ETFE), ethylene-propylene copolymer (EPC), poly(4-methyl-1-pentene) polyolefin (such as by nonlimiting example the TPX® polyolefins available from Mitsui Chemicals, Inc.), other fluoropolymers, or the like. Such dielectric materials have a lower relative permittivity than those of the dielectric materials of the first insulating jacket 406. As a result of the combination of the first insulating jacket 406 and the second insulating jacket 408, the electric field is redistributed within the insulating jackets and the resulting electric field has a lower maximum intensity than in single-layer insulation.

Referring again to FIG. 4, the first insulating jacket 406 may be mechanically and/or chemically bonded to the second insulating jacket 408 so that the interface therebetween will be substantially free of voids. Also, the polymeric protective layer 412 may be mechanically and/or chemically bonded to the first insulating jacket 406. To illustrate, for example, the second insulating jacket 408 may be mechanically bonded to the first insulating jacket 406 as a result of molten or semi-molten material, forming the second insulating jacket 408, being adhered to the first insulating jacket 406. Further, the second insulating jacket 408 may be chemically bonded to the first insulating jacket 406 if the material used for the second insulating jacket 408 chemically interacts with the material of the first insulating jacket 406. The first insulating jacket 406 and the second insulating jacket 408 are capable of suppressing an electric field produced by a voltage applied to the outer conductor 404. The central insulated conductor 402, the outer insulated conductors 404, and the polymeric protective layer 412 are provided in a compact geometric arrangement to efficiently utilize the available diameter of the cable 400.

The volume within the insulating layer 406 not taken by the central metallic conductor 402, the outer coated metallic conductors 404, and polymeric protective layer 412, may be filled by a filler. The filler may be made of either an electrically conductive or an electrically non-conductive material, or may be the same material forming the polymeric protective layer 412. Such non-conductive materials may include ethylene propylene diene monomer (EPDM), nitrile rubber, polyisobutylene, polyethylene grease, or the like. Conductive materials that may be used as the filler may include EPDM, nitrile rubber, polyisobutylene, polyethylene grease, or the like mixed with an electrically conductive material, such as carbon black.

The insulating jackets and/or protective polymeric layers of cables according to the invention may further include a fluoropolymer additive, or fluoropolymer additives, in the material admixture that forms the jackets or layers. Such additive(s) may be useful to produce long cable lengths of high quality at high manufacturing speeds. Suitable fluoropolymer additives include, but are not necessarily limited to, polytetrafluoroethylene, perfluoroalkoxy polymer, ethylene tetrafluoroethylene copolymer, fluorinated ethylene propylene, perfluorinated poly(ethylene-propylene), and any mixture thereof. The fluoropolymers may also be copolymers of tetrafluoroethylene and ethylene and optionally a third comonomer, copolymers of tetrafluoroethylene and vinylidene fluoride and optionally a third comonomer, copolymers of chlorotrifluoroethylene and ethylene and optionally a third comonomer, copolymers of hexafluoropropylene and ethylene and optionally third comonomer, and copolymers of hexafluoropropylene and vinylidene fluoride and optionally a third comonomer. The fluoropolymer additive should have a melting peak temperature below the extrusion processing temperature, and preferably in the range from about 200° C. to about 350° C.

To prepare an insulating jacket and/or protective polymeric admixture, the fluoropolymer additive is mixed with a jacket or polymeric material prior to coating the electrical conductors. The fluoropolymer additive may be incorporated into the admixture in the amount of about 5% or less by weight based upon total weight of admixture, preferably about 1% by weight based or less based upon total weight of admixture, more preferably about 0.75% or less based upon total weight of admixture.

Cables according the invention, may be grouped together as insulated conductors to form larger cables. For example, insulated conductor 400 in FIG. 4, may be grouped with a plurality of other such insulated conductors to form a larger cable. While there are no limitations to the number of insulated conductors which may be grouped to form larger cables, it is preferable to group four such insulated conductors to form a quad-cable, and seven such conductors may be grouped to form a hepta-cable.

Figure 6:
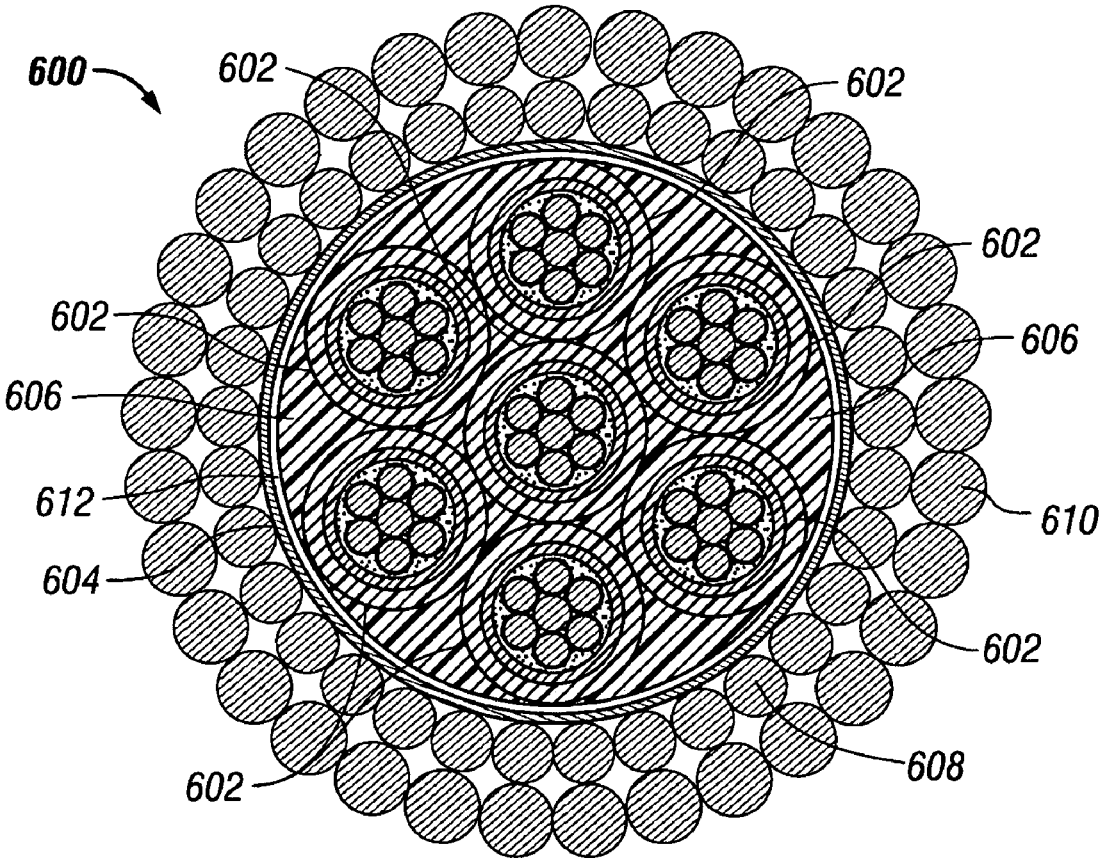
FIG. 6 illustrates, in cross section, a cable according to the invention

In the embodiment of the invention illustrated in FIG. 6, a hepta-cable 600, seven stacked dielectric insulated conductors 602 with protective polymer layers, which may be similar to insulated conductor 400 as illustrated in FIG. 4, are grouped together to form a larger cable. The six outer insulated conductors are encircled by an outer jacket 604 made of a material that may be either electrically conductive or electrically non-conductive and that is capable of withstanding high temperatures. Such non-conductive materials may include the polyaryletherether ketone family of polymers (PEEK, PEKK), ethylene tetrafluoroethylene copolymer (ETFE), other fluoropolymers, polyolefins, or the like. Conductive materials that may be used in the jacket 604 may include PEEK, ETFE, other fluoropolymers, polyolefins, or the like mixed with a conductive material, such as carbon black. A first armor layer 608 and a second armor layer 610, generally made of a high tensile strength material such as galvanized improved plow steel, alloy steel, or the like, surround the outer jacket 604 to protect the outer jacket 604, the non-conductive filler 606, the insulated conductors 602 from damage.

Referring again to FIG. 6, the volume within the outer jacket 604 not occupied by the insulated conductors 602 may be filled, by an interstitial filler 606. Such interstitial filler 606 may comprise materials including ethylene propylene diene monomer (EPDM), nitrile rubber, perfluoropolyether polymers, perfluoropolyether-silicone polymers, polyisobutylene polymers, polyethylene grease, low volatility grease (such as Krytox®), fluoropolymers, silicones, vulcanizable or cross-linkable polymers, metallic conductors, wires, drain wires, TFE yarns, cotton yarns, polyester yarns, any suitable gel, and the like, or any mixtures thereof. Any of the materials that may be used as the interstitial filler 606 may be mixed with an electrically conductive material, such as carbon black. A particularly useful interstitial filler material that is also resistant to corrosive chemicals, including hydrogen sulfide, is SIFEL™, a liquid perfluoropolyether-silicone polymer available from Shin-Etsu MicroSi, Inc., Phoenix, Ariz. 85044.

The interstitial filler 606 may also comprise a further material to adjust the dielectric constant, or even reduce the coefficient of friction, such as by non-limiting example, PTFE powder. Such a material may allow the insulated conductors 602 to move relative to each other much more easily, and prolong the life of the cable. The interstitial filler 606 may be non-conductive or conductive depending on the telemetry and power needs of individual cable designs. If the interstitial filler 606 is non-conductive, a thermoplastic jacket may be extruded thereover to prevent intrusion of well fluids, which would damage the effect of the interstitial filler 606.

Referring once again to FIG. 6, the interstitial filler 606 may be further surrounded by a cabling tape 612 to which may serve to contain the interstitial filler during the cabling process. Suitable cabling tape 612 materials include polyester, PPS, PEEK, glass-fiber tape, glass-fiber tape coated with PTFE, fluoropolymers (including Tefzel®, perfluoroalkoxyalkane [PFA], Metafluoro-alkoxyalkane [MFA], fluorinated ethylene propylene [FEP]), tensile strength enhanced PTFE, and the like. The tape 612 may be served between the interstitial filler 606 and outer jacket 604, or alternatively, between the outer jacket 604 and first armor layer 608.

Figure 7:
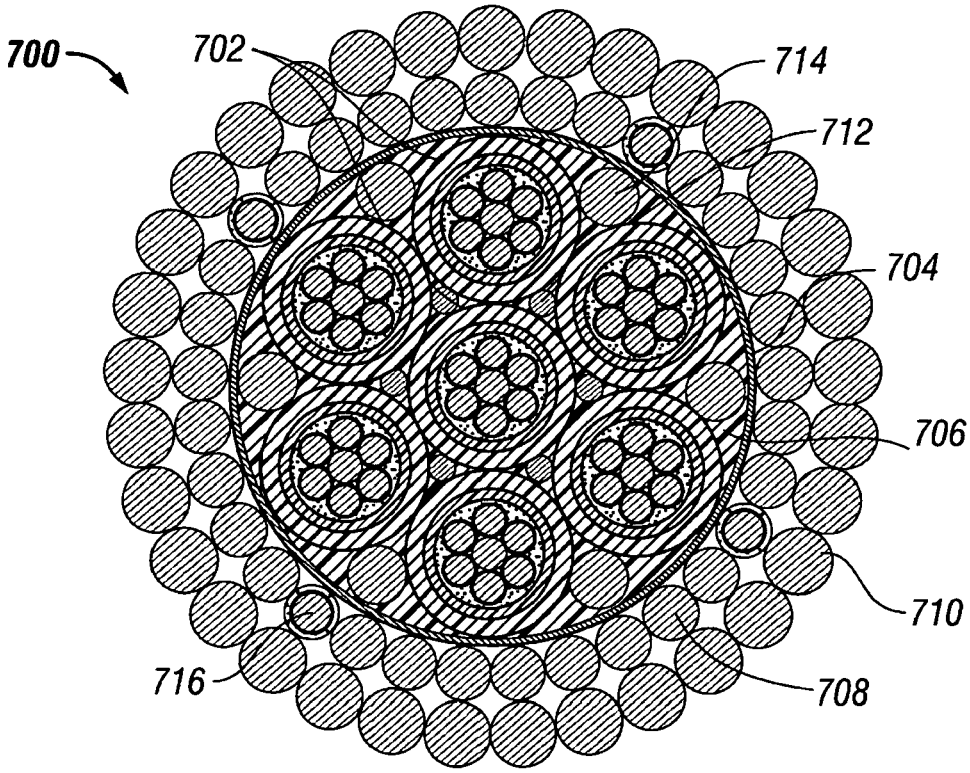
FIG. 7 illustrates, in cross section, a cable according to the invention which further comprises current return conductors.

FIG. 7 illustrates a cable according to the invention which further comprises current return conductors. The cable 700 includes a plurality of insulated conductors 702, which may be like insulated conductor 400 as illustrated in FIG. 4, and the insulated conductors 702 are encircled by an outer jacket 704. The volume within the outer jacket 704 not occupied by the insulated conductors 702 or other components, may be filled, by an interstitial filler 706. A first armor layer 708 and a second armor layer 710, generally made of a high tensile strength material such as galvanized improved plow steel, alloy steel, or the like, surround the outer jacket 704 for protection. Current return conductors 712 and 714 may also be placed in interstitial spaces to provide a current return path from downhole to the surface. While any suitable conuctor material may be used, aluminum, copper, coated copper, copper alloys, or nickel coated copper are preferred. Some armor wires may further be replaced by coated conductors and used as current return conductors 716. Examples of suitable coated conductors are those that have polymeric coatings or metallic coatings, and may be solid conductors or stranded conductors. Preferably, the drain wires 716 are nickel coated copper wires.

Figure 8:
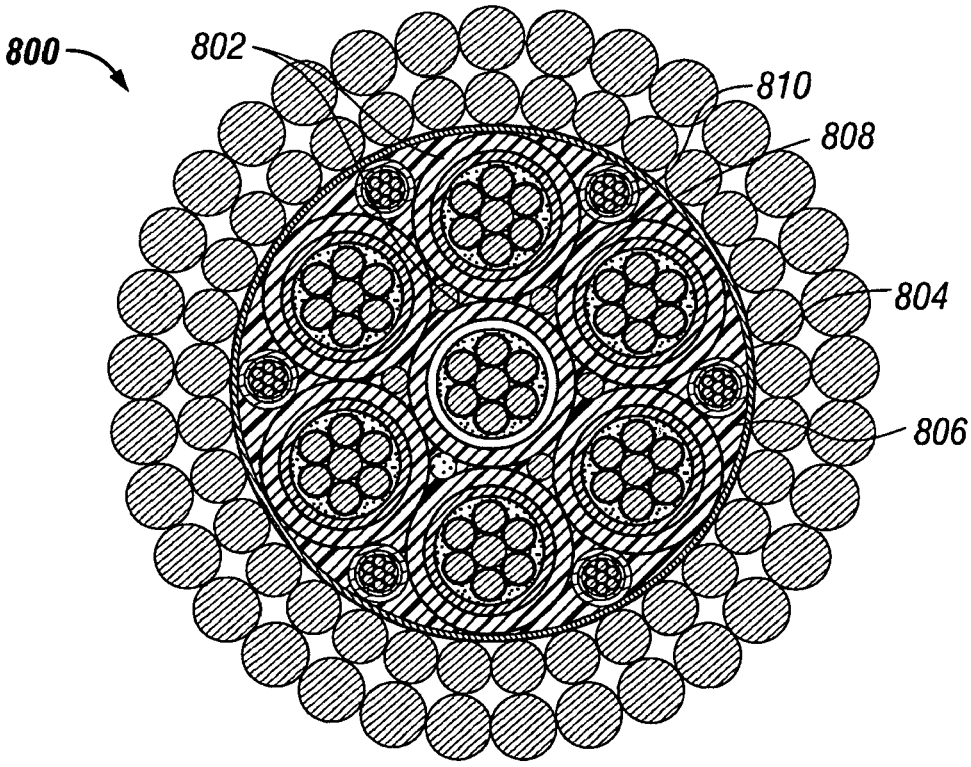
FIG. 8 illustrates, in cross section, a cable according to the invention which further includes smaller conductors in interstitial spaces.

FIG. 8 illustrates yet another embodiment of the invention. The cable 800 includes a plurality of insulated conductors 802, which may be like insulated conductor 400 as illustrated in FIG. 4, encased by an outer jacket 804. The volume within the outer jacket 804 not occupied by the insulated conductors 802 or other components, may be filled, by an interstitial filler 806 and miniature insulated conductors 810 similar to insulated conductor 400. A first and a second armor layer, surround the outer jacket 804 for protection. Current return conductors 808 may also be placed in interstitial spaces to provide a current return path from downhole.

The present invention is not limited, however, to cables having only metallic conductors. Optical fibers may be used in place of metallic conductors in order to transmit optical data signals to and from the device or devices attached thereto, which may result in higher transmission speeds, lower data loss, and higher bandwidth.

In one application of the present invention, insulated conductors 400, 500 and the cables 600, 700, 800 are used to interconnect well logging tools, such as gamma-ray emitters/receivers, caliper devices, resistivity-measuring devices, neutron emitters/receivers, and the like, to one or more power supplies and data logging equipment outside the well. Thus, the materials used in the cables 400, 500, 600, 700, and 800 are, in one embodiment, capable of withstanding conditions encountered in a well environment, such as high temperatures, hydrogen sulfide-rich atmospheres, and the like.

Methods for manufacturing an insulated conductor are also provided according to the invention. The methods include providing a plurality of coated metallic conductors, extruding a polymeric protective layer thereon, extruding a first insulating jacket having a first relative permittivity around the polymeric protective layer, and then extruding a second insulating jacket having a second relative permittivity that is less than the first relative permittivity around the first insulating jacket. The relative permittivity values of the first insulating jacket and the second insulating jacket may be commensurate with those described previously. The protective layer and insulating jackets may be placed around the electrical conductors by using a compression extrusion method, a tubing extrusion method, or a semi-compression extrusion method. The extrusion temperature is typically from about 200° C. or higher.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

We claim:

1. A corrosion resistant wellbore cable comprising:

(a) an electrical conductor comprising a central coated metallic conductor and a plurality of coated metallic conductors helically positioned around said central coated metallic conductor;

(b) a coating flake trapping polymeric layer disposed adjacent the electrical conductor;

(c) a first insulating jacket disposed adjacent the polymeric layer wherein the first insulating jacket has a first relative permittivity; and (d) a second insulating jacket disposed adjacent the first insulating jacket and having a second relative permittivity that is less than the first relative permittivity, and wherein the first insulating jacket is mechanically bonded to the second insulating jacket;

wherein the polymeric layer has a relative permittivity less than the first relative permittivity.

2. A cable according to claim 1 wherein said central metallic conductor is a coated copper conductor.

3. A cable according to claim 1 wherein said central and plurality of coated metallic conductors are nickel coated copper conductors.

4. A cable according to claim 1 wherein said polymeric layer includes a material selected from the group consisting of polyaryletherether ketone polymer, polyphenylene sulfide polymer, polyether ketone polymer, maleic anhydride modified polymers, Parmax® SRP polymers, copolymers of tetrafluoroethylene and ethylene, and any mixtures thereof.

5. A cable according to claim 4 wherein said polymeric layer material has a relative permittivity greater than 2.3.

6. A cable according to claim 1 wherein said first insulating jacket comprises a dielectric material selected from the group consisting of polyaryletherether ketone polymer, polyphenylene sulfide polymer, polyether ketone polymer, maleic anhydride modified polymers, Parmax® SRP polymers, copolymers of tetrafluoroethylene and ethylene, and any mixtures thereof.

7. A cable according to claim 1 wherein said first insulating jacket comprises a fluoropolymer additive.

8. A cable according to claim 7, wherein said fluoropolymer additive is incorporated in the amount of about 5% or less by weight based upon total weight of said first insulating jacket.

9. A cable according to claim 1, wherein said first relative permittivity is within a range of about 2.5 to about 10.

10. A cable according to claim 1, wherein a thickness of said polymeric layer between said first insulating jacket and the outer surface of said electrical conductor is within a range from about 1 micrometer to about 153 micrometers.

11. A cable according to claim 1, wherein a thickness of the first insulating jacket is within a range of from about 10 micrometers to about 153 micrometers.

12. A cable according to claim 1, wherein the second relative permittivity is within a range of about 1.8 to about 5.0.

13. A cable according to claim 1, wherein the second insulating jacket is made of a material selected from the group consisting of polytetrafluoroethylene-perfluoromethylvinylether polymer, perfluoro-alkozyalkane polymer, polytetrafluoroethylene polymer, ethylene-tetrafluoroethylene polymer, ethylene-propylene copolymer, polyethylene, poly(4-methyl-1-pentene) polyolefin, and fluoropolymer.

14. A cable according to claim 1, further comprising: an outer jacket surrounding the second insulating jacket, and an interstitial filler disposed between the outer jacket and the second insulating jacket.

15. A cable according to claim 14, further comprising an armor wire layer surrounding the outer jacket.

16. A cable according to claim 15 wherein said armor wire layer comprises at least one current return conductor.

17. A cable according to claim 14, wherein the outer jacket is made from a material selected from the group consisting of the polyaryletherether ketone family of polymers, ethylene tetrafluoroethylene copolymer, fluoropolymer, and polyolefin.

18. A cable according to claim 14, wherein the interstitial filler is made from a material selected from the group consisting of perfluoropolyether polymers, perfluoropolyether-silicone polymers, grease, fluoropolymers, and any mixtures thereof.

19. A cable according to claim 14 further comprising at least one drain wire disposed within said outer jacket.

20. A cable according to claim 1, wherein a capacitance of the electrical conductor in combination with the first insulating jacket and the second insulating jacket is within the range of from about 98 picofarads per meter to about 230 picofarads per meter.

21. A cable according to claim 1 further comprising at least one current return conductor.

22. A cable according to claim 21 wherein said current return conductor is a nickel coated copper conductors.

23. A corrosion resistant wellbore cable comprising:

(a) a plurality of insulated electrical conductors, each of said conductors comprising:

(i) a central coated metallic conductor and a plurality of coated metallic conductors helically positioned around said central coated metallic conductor;

(ii) a coating flake trapping polymeric layer disposed adjacent the electrical conductor;

(iii) a first insulating jacket disposed adjacent the polymeric layer wherein the first insulating jacket has a first relative permittivity; and, (iv) a second insulating jacket disposed adjacent the first insulating jacket and having a second relative permittivity that is less than the first relative permittivity, and wherein the first insulating jacket is mechanically bonded to the second insulating jacket;

wherein the polymeric layer has a relative permittivity less than the first relative permittivity;

(b) an outer jacket surrounding said plurality of said insulated electrical conductors, and an interstitial filler disposed between the outer jacket and said insulated electrical conductors, wherein the interstitial filler is made from a material selected from the group consisting of perfluoropolyether polymers, perfluoropolyether-silicone polymers, Krytox® grease, fluoropolymers, and any mixtures thereof;

(c) a plurality of current return conductors disposed between the outer jacket and said insulated electrical conductors; and, (d) at least one armor wire layer surrounding the outer jacket.

24. A cable according to claim 23 which is a hepta-cable, or quad-cable design.

25. A corrosion resistant wellbore cable comprising:

(a) a plurality of insulated electrical conductors, each of said conductors comprising:

(i) a central coated metallic conductor and a plurality of coated metallic conductors helically positioned around said central coated metallic conductor;

(ii) a coating flake trapping polymeric layer disposed adjacent the electrical conductor;

(iii) a first insulating jacket disposed adjacent the polymeric layer wherein the first insulating jacket has a first relative permittivity; and, (iv) a second insulating jacket disposed adjacent the first insulating jacket and having a second relative permittivity that is less than the first relative permittivity, and wherein the first insulating jacket is mechanically bonded to the second insulating jacket;

wherein the polymeric layer has a relative permittivity less than the first relative permittivity;

(b) an outer jacket surrounding said plurality of said insulated electrical conductors, and an interstitial filler disposed between the outer jacket and said insulated electrical conductors;

(c) at least one armor wire layer surrounding the jacket which further comprises at least one current return conductor disposed about the armor wire layer.

26. A method of providing a corrosion resistant wellbore electrical cable with improved durability, the method comprising:

(a) providing at least one coated electrical conductor;

(b) extruding a coating flake trapping polymeric layer over the electrical conductor, the polymeric layer comprising coating flakes produced during manufacture of the cable;

(c) extruding a first insulating jacket having a first relative permittivity over the polymeric layer; and (d) extruding a second insulating jacket having a second relative permittivity over the first insulating jacket, wherein the second relative permittivity is less than the first relative permittivity;

wherein the polymeric layer has a relative permittivity less than the first relative permittivity.

27. A method according to claim 26, wherein extruding the first insulating jacket further comprises compression.

28. A method according to claim 27, wherein extruding the second insulating jacket further comprises extruding the second insulating jacket by a method selected from the group consisting of tubing extrusion, compression extrusion, and semi-compression extrusion.

29. A method according to claim 26, wherein extruding the second insulating jacket further comprises extruding the second insulating jacket such that the second insulating jacket is mechanically bonded to the first insulating jacket.

30. A method according to claim 26, wherein extruding the second insulating jacket further comprises extruding the second insulating jacket such that the second insulating jacket is chemically bonded to the first insulating jacket.

31. A method according to claim 26, wherein the first insulating jacket and the second insulating jacket are separately extruded by tandem extrusion.

* * * * *